United States Patent [19]

May et al.

[11] Patent Number: 4,991,717

[45] Date of Patent: Feb. 12, 1991

[54] LIGHT AND MOISTURE RESISTANT PACKAGE

[75] Inventors: Robert D. May, Brockport; John M. Williamson, Fairport, both of N.Y.

[73] Assignee: Eastman Kodak Company, Rochester, N.Y.

[21] Appl. No.: 471,446

[22] Filed: Jan. 29, 1990

[51] Int. Cl.[5] ..... B65D 85/00

[52] U.S. Cl. ..... 206/455; 206/631.1; 206/621; 220/254; 220/256; 220/259; 220/339

[58] Field of Search ..... 206/601, 621, 631.1, 206/634, 455, 470; 220/254, 256, 257, 259, 270, 276, 339

[56] References Cited

U.S. PATENT DOCUMENTS

| | | | |
|---|---|---|---|
| 1,101,907 | 6/1914 | Cummings | 206/455 |
| 2,354,706 | 8/1944 | Rulon | 206/62 |
| 3,392,820 | 7/1968 | Azim | 206/1 |
| 3,421,654 | 1/1969 | Hexel | 220/339 |
| 3,721,364 | 3/1973 | Lukaschewitz et al. | 220/41 |
| 3,782,583 | 1/1974 | Abbey | 220/339 |
| 3,810,229 | 5/1974 | Dunning et al. | 95/19 |
| 3,904,074 | 9/1975 | Hoffman et al. | 220/339 |
| 4,000,816 | 1/1977 | Spruyt | 206/498 |
| 4,020,969 | 5/1977 | Ando | 220/256 |
| 4,346,833 | 8/1982 | Bernhardt | 220/257 |
| 4,420,111 | 12/1983 | Hament | 220/339 |
| 4,498,588 | 2/1985 | Scott | 206/526 |
| 4,498,589 | 2/1985 | Scott et al. | 206/526 |
| 4,555,043 | 11/1985 | Bernhardt | 220/257 |
| 4,724,979 | 2/1988 | Cleevely et al. | 220/270 |
| 4,727,391 | 2/1988 | Tajima et al. | 354/277 |
| 4,799,591 | 1/1989 | Tajima et al. | 206/455 |
| 4,828,106 | 5/1989 | Akao et al. | 206/316.1 |
| 4,858,780 | 8/1989 | Odaka et al. | 220/359 |
| 4,889,233 | 12/1989 | Torii | 206/455 |

*Primary Examiner*—David T. Fidei

*Attorney, Agent, or Firm*—Charles E. Snee, III

[57] ABSTRACT

The molded container body (10) and molded lid panel (34, 46, 48) are joined by a light and moisture impervious seal membrane (54) which fixedly adheres to the upper surface of the lid panel but peelably adheres to the upper surface of a peripheral flange (20) on the container body, thus permitting one lid portion (46) to be raised to an open position by peeling the seal membrane away from flange (20) and pulling upward, without removing the seal membrane from the lid panel.

21 Claims, 3 Drawing Sheets

LIGHT AND MOISTURE RESISTANT PACKAGE

DESCRIPTION

1. Technical Field

This invention concerns improvements in packages for various products. More particularly, the invention relates to improved light and moisture resistant packages which are especially well suited for photographic film and paper or other light and/or moisture sensitive products.

2. Background Art

Numerous products are marketed which are sensitive to light or moisture or both. For many years, packaging engineers have developed packaging systems intended to eliminate one or both of such environmental influences, with widely varying degrees of success. For example, U.S. Pat. No. 1,101,907 discloses a box for photographic products in which a paperboard tray for the products can be moved in and out of the box through a resiliently baised hinged cover at one end, the hinge being covered with cloth tape for light tightness. In U.S. Pat. No. 2,354,706, a photographic package is shown in which the hinged top has downwardly extending peripheral flanges which are received in a channel defined in the double walled bottom to provide a light seal. U.S. Pat. No. 3,392,820 shows a receptacle for photographic paper and the like in which the top is hinged with mating concave and convex members for light tightness. An all plastic container for photosensitive materials is shown in U.S. Pat. No. 3,721,364 in which the cover slides open and closed through a light tight flange or may be attached by tape or a heat seal. In U.S. Pat. No. 3,810,229, a light tight cartridge for aperture cards is disclosed in which enlarged peripheral rims or beads snap into channels to provide moisture and light tight seals.

A moisture impervious packaging system is shown in U.S. Pat. No. 4,000,816 in which the container includes a peripheral lip surrounded by a peripheral frame member for the lid, with a membrane extended across the open mouth of the package and adhered to both the lip and the frame to provide a seal. U.S. Pat. No. 4,346,833 shows a multiple seal package in which a cover membrane bearing advertising indicia adheres to both the top and a flange on the container. The membrane is scored or otherwise weakened; so that, the membrane and the advertising remain adhered to the top after the seal to the flange has been broken. The reclosable packaging system disclosed in U.S. Pat. No. 4,498,588 and 4,498,589 includes a container and top having congruent flanges which capture between them an adhesive mat which adheres permanently on one side to one flange and releasably on the other side to three of four edges of the other flange. More recently, U.S. Pat. No. 4,828,106 discloses a packaging case for photosensitive sheets comprising a rigid light shielding tray with an open mouth peripherally heat sealed by a flexible light shielding membrane.

While the packaging systems shown in these references have achieved certain degrees of success in their particular applications, a need has continued to exist for a package for light and moisture sensitive materials which is substantially impervious to both light and moisture when initially closed about the product, but can be opened for removal of the product by only partially breaking its light and moisture seals and then reclosed to a light tight configuration. Such a package would eliminate the need for a second moisture proof wrapping on the product before it is placed in the package, as often has been required with such packaging systems. A need has also existed for such a package which can be easily loaded and unloaded by hand, but which lends itself to automatic loading and sealing.

SUMMARY OF THE INVENTION

The primary object of this invention is to provide an improved light and moisture tight package for photographic and other sensitized materials.

Yet another object of this invention is to provide such a package which can be easily opened for access to its contents and closed to provide a light tight seal.

Still another object of this invention is to provide such a package which can be formed with conventional vacuum or injection molding techniques using readily available plastic materials.

A further object of this invention is to provide such a package which is simple to load manually but also lends itself to automatic form, fill and seal processes.

These objects are given only by way of illustrative examples; thus, other desirable objectives and advantages inherently achieved by the disclosed invention may occur or become apparent to those skilled in the art. Nonetheless, the scope of the invention is to be limited only by the appended claims.

The preferred embodiment of the invention includes a container body having a bottom wall and upwardly extending side walls which surround an interior compartment, the upper edges of the side walls surrounding an access opening into the compartment. A laterally and peripherally extending flange is attached to the upper edges of the side walls and supports a lid panel which extends across the access opening and partially across the flange whereby a peripheral portion of the flange remains exposed. The lid panel is provided with means extending across the access opening for permitting a portion of the panel to be raised to an open position. Particularly in accordance with the invention, a light and moisture impervious seal membrane is adhered to the upper surface of the lid panel and extended across the means for permitting a portion of the lid panel to be raised. The seal membrane preferably is fixedly adhered at least to the peripheral edge of the lid panel, while at the same time being peelably adhered to the upper surface of the exposed peripheral portion of the flange of the container body. Thus, the seal membrane provides a light and moisture impervious seal both for the means for permitting a portion of the lid panel to be raised, and between the lid panel and the flange. As a result of this unique configuration, the seal membrane may be manually peeled away from the flange and then grasped and pulled to lift the portion of the lid panel to its open position, while the seal means remains fixedly adhered to the lid panel. Such differential sealing or adhering of the seal membrane to the flange and the lid panel is provided by the unique choices of materials for these elements of the invention, as will be discussed in detail further on in this description.

To provide alight seal for the package even when its seal membrane has been peeled from the flange, the lid panel is provided with a peripherally extending, downwardly protruding lip which fits into a complementary peripherally extending, upwardly opening channel in the flange, which channel is closed at its mouth by the seal membrane when the package is first assembled. To hold the lip within the channel, the channel preferably is provided in its walls with a plurality of abutments or protuberances beneath which the lip snaps when the lid panel is closed. The means for permitting a portion of the lid panel to be raised to an open position may be formed by simple overlapping flanges between portions of the lid panel, the flanges being covered by the seal membrane which also acts as a hinge; or by an integral, flexible transverse section of reduced thickness or other configuration in the lid panel, also covered by the seal membrane.

The seal membrane used in the package of the invention preferably is a material having an upper layer to provide a moisture barrier and a blackened plastic lower layer to provide a light barrier. Where the package is to be used for photographic sensitized products, the upper layer perferably is a metal foil or metallized layer. Black polyethylene is preferred for such lower layer; however, any material may be used which has the desired light barrier characteristics combined with the properties of adhering fixedly to the upper surface of the lid panel but adhering peelably to the upper surface of the flange of the container body. A suitable material for the lid panel is a coextrusion or laminate of polystyrene on the lower surface for rigidity, preferably of the rubber modified, high impact variety; and low density polyethylene on the upper surface. Suitable materials for the upper surface of the flange of the container body are polypropylene; or a coextrusion or laminate of polypropylene on the upper surface and polystyrene on the lower surface, preferably of the rubber modified, high impact variety.

BRIEF DESCRIPTION OF THE DRAWINGS

The foregoing and other objects, features and advantages of the invention will be apparent from the following more particular description of the preferred embodiments of the invention, as illustrated in the accompanying drawings.

DETAILED DESCRIPTION OF THE PREFERRED EMBODIMENTS

Figure 1:
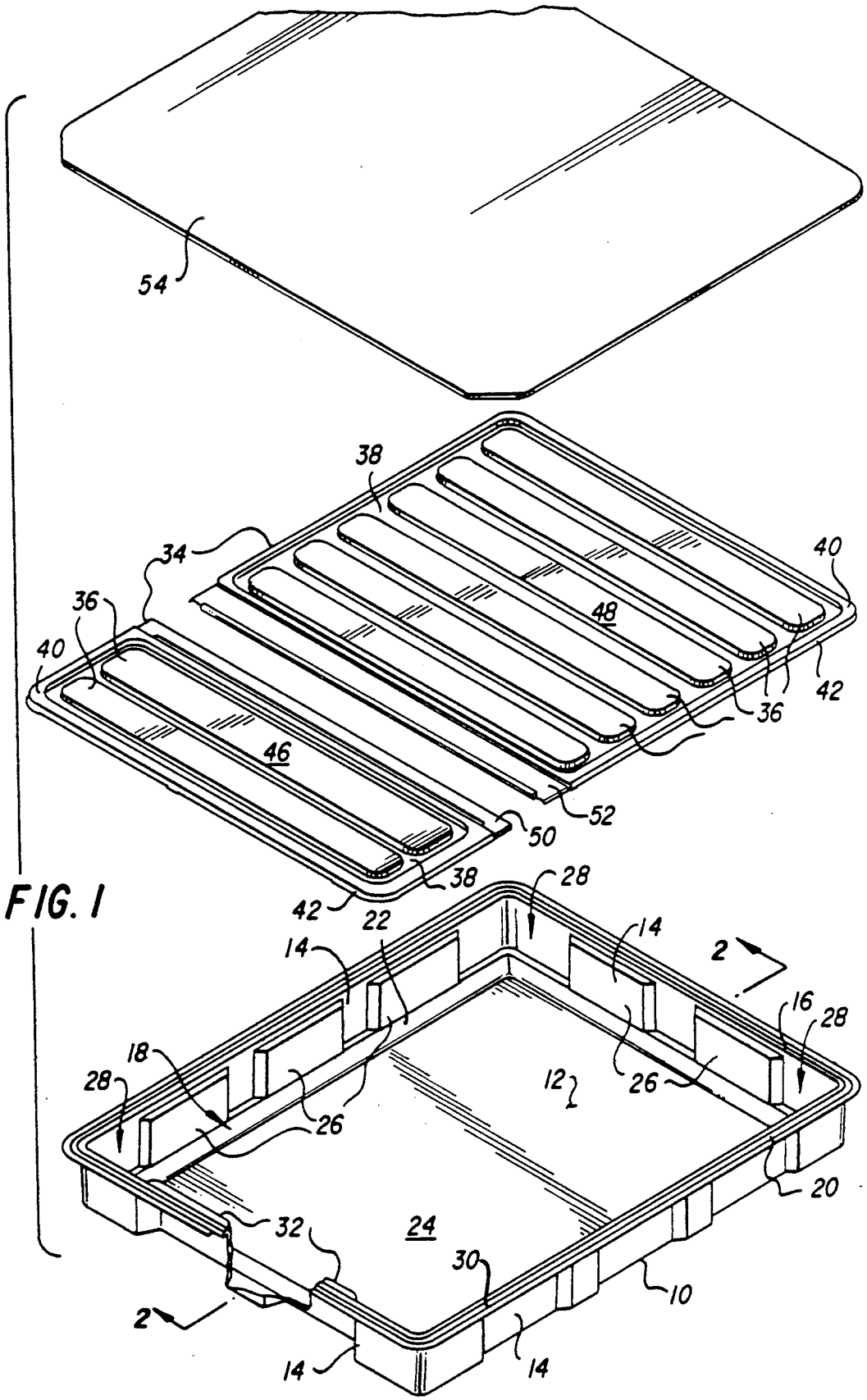
FIG. 1 shows an exploded, perspective view of a package made in accordance with the invention.

The following is a detailed description of the preferred embodiments of the invention, reference being made to the drawings in which the same reference numerals identify the same elements of structure in each of the several Figures.

Figure 2:
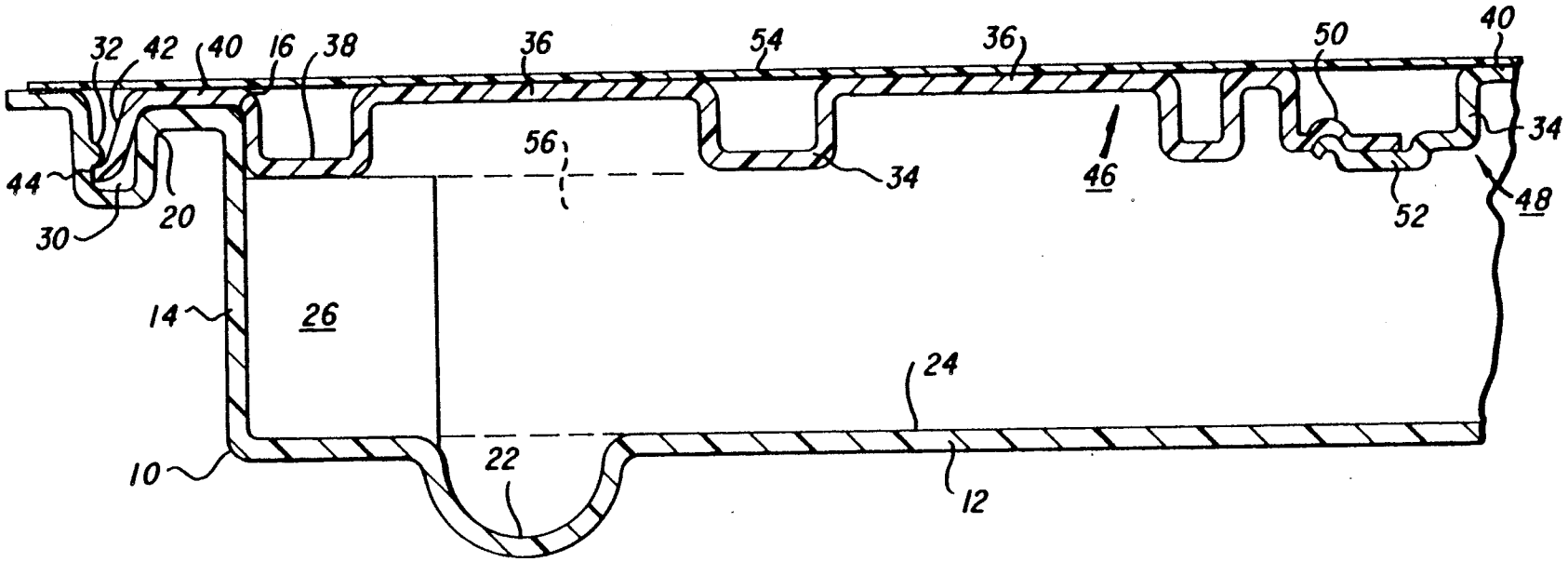
FIG. 2 shows a fragmentary, sectional view taken along line 2—2 of FIG. 1.

FIGS. 1 and 2 show the packaging system according to the invention, which comprises a molded, preferably rectangular container body 10 having a bottom wall 12 integrally formed with upwardly extending side walls 14 having upper edges 16 surrounding an access opening 18. An integrally formed, laterally and peripherally extending flange 20 is provided at upper edges 16. Preferably flange 20 extends laterally outwardly from opening 18 for ease of manufacture, but an inwardly extending flange would also be within the scope of our invention. Formed in bottom wall 12 is a downwardly and peripherally extending rib portion 22 which defines a support for the container and also enhances its structural rigidity. Within the bounds of rib portion 22 is defined as essentially rectangular central area 24 on which the product rests during use, with the edges of the product extending over rib 22. To prevent lateral movement of the product and also to add structural rigidity, a plurality of laterally inwardly extending abutments 26 are molded into side walls 14 at regular intervals, except at the corners. The omission of abutments 26 at the corners ensures that when the product is sheets of material such as photographic film or paper, the corners of such sheets will not become bent or torn due to contact with the package.

Figure 4:
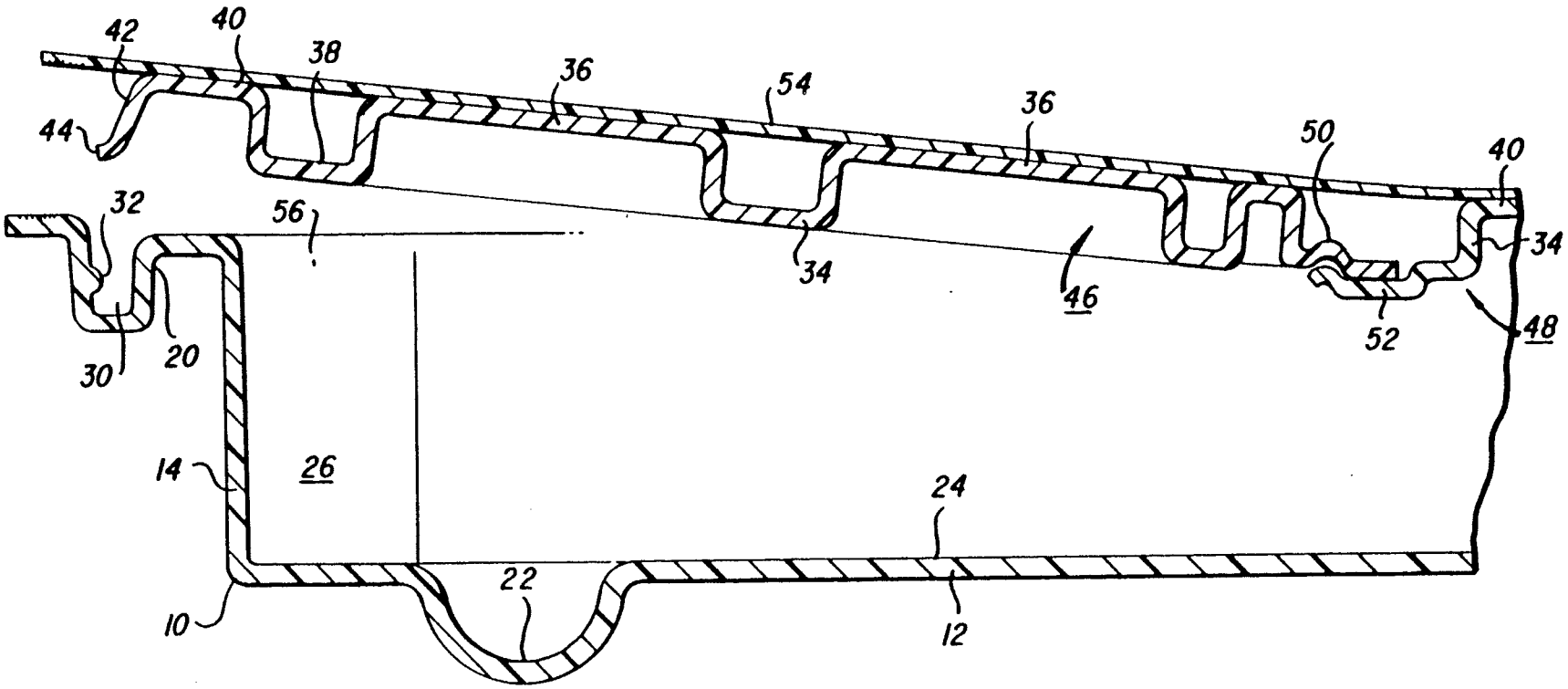
FIG. 4 shows the structure of FIG. 2 when one portion of the lid panel has been raised to its open position.

As best seen in FIG. 2, flange 20 comprises a peripherally extending, upwardly opening channel 30 having a plurality of laterally extending abutments or protuberances 32 spaced along its outer walls. Abutments 32 may be provided all around channel 30, but preferably are applied at the end of container body at which the lid panel 34 of the package may be raised to an open position as shown in FIG. 4. Those skilled in the art will appreciate that the structure of container body 10 may be formed by vacuum or injection molding, as preferred in accordance with the particular materials selected for the package.

Lid panel 34 comprises a plurality of upwardly facing reinforcing ribs 36 extending from the panel base plane 38, the underside of which engages the product when the package is full. At the periphery of base plane 38 is provided a peripheral rib 40 having at its outer edge a peripherally extending, downwardly protruding lip 42 which is sized to fit well into channel 30 when lid panel 34 is fitted to container body 10. Lip 42 includes a laterally outward extension 44 which is positioned to snap beneath abutments 32 when the lid panel is seated on the container body. Thus, lid panel 34 extends partially across flange 20, leaving a peripheral portion of the flange exposed.

To provide access to the interior compartment of the container body 10 to permit removal of at least a portion of its contents, lid panel 34 preferably is divided into two portions: 46 which can be raised to an open position and 48 which is intended to remain closed to protect the contents. Portion 46 may be approximately one third of the overall length of a lid panel of, say, about twelve inches in overall length, but the length of portion 46 is chosen to provide ease of access of the user's hand and removal of the product. Portions 46,48 are provided with overlapping flanges 50,52, with flange 50 on portion 46 overlapping flange 52 on portion 48, as seen most clearly in FIG. 2.

Portions 46,48 are secured to each other and lid panel 34 is secured to flange 20 by means of a seal membrane 54 having approximately the same area as that bounded by the periphery of flange 20. As discussed previously, seal membrane 54 preferably is made from a material having an upper layer to provide a moisture barrier and a black plastic lower layer to provide a light barrier. Such membranes may be manufactured by conventional laminating and coextruding processes. In photographic applictions, the outer layer may be 0.00025 to 0.00035 inch (0.000635 to 0.000889 mm) aluminum adhered to a suitable plastic inner layer. Membrane 54 may also comprise an upper layer of paper or plastic, an inner layer of metallic foil or other moisture barrier material and a lower layer of blackened polyethylene.

The materials of such lower layer, the upper surface of lid panel 34 and the upper surface of flange 20 are chosen so that seal membrane 54 can be fixedly adhered at least to the peripheral portion of the upper surface of lid panel 34, but peelably adhered to the peripheral portion of the upper surface of flange 20. As used in this description, "fixedly adhered" means that a permanent or virtually permanent bond is achieved, such that separation by peeling is very difficult or impossible to accomplish without damaging the membrane material. And "peelably adhered" means that sufficient bond is achieved to hold the two elements together during normal handling and shipping, yet the membrane can be peeled away with relative ease. The desired result is that membrane 54 peels away from flange 20, lifting lid portion 46 without noticeably peeling away from lid portions 46,48. Any technique for providing such adherence is within the scope of our invention. Particularly good peelable seals are achievable when the underside of membrane 54 is coated with a seal promoter such as that sold under the trade name RP-1A by Rollprint Packaging Products, Inc. of Addison, Illinois, U.S.A. Such adherence preferably is achieved by heat sealing to the coplanar surfaces of flange 20 and lid panel 34, but the use of adhesives having the indicated properties is also within the scope of the invention. When the lower surface of membrane 54 is polyethylene and the upper surface of flange 20 is polypropylene, a satisfactory peelable seal is achieved with a sealing pressure of about 40 psi (275.8 kPa), a dwell time of about 0.5 sec and a temperature in the range of about 350 to 380 degrees Fahrenheit (176.7 to 193.3 degrees Centigrade).

Figure 3:
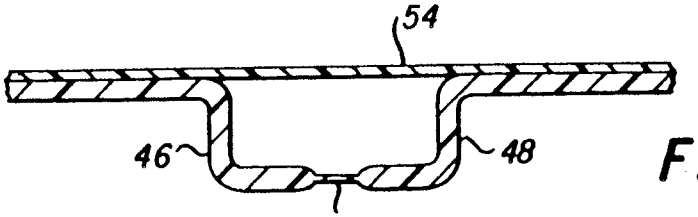
FIG. 3 shows a fragmentary, sectional view of an alternate form of the means for permitting a portion of the lid panel to be raised.

Because seal membrane 54 extends above the overlapping flanges 50,52, it acts not only as a light and moisture seal at that location, but also as the flexing member of the simple hinge formed by flanges 50,52. Stepped overlap of flanges 50,52 also contributes to light tightness when membrane 54 has been peeled back around the access opening. See FIG. 4. Rather than making lid panel 34 in two portions 46,48, it also is within the scope of the invention to provide an integral, flexible and transverse section 58 of reduced thickness or other configuration across the width of lid panel 34, as shown for example in FIG. 3. Section 58 is covered by membrane 54 and of sufficient thinness or other geometry to flex as a hinge without breaking, as is known in the packaging arts.

In use, container body 10 is formed sing known techniques and a stack of product 56 is placed on surface 24. Then, lid portions 46,48 are put in place and seal membrane is applied so that it seals to the upper surfaces of ribs 36 and 40 of lid panel 34 and the coplanar upper and outer surface of flange 20, in the manner previously described. Sealing to the upper surfaces of ribs 36 is not essential, however. When it is desired to open the package, membrane 54 is manually peeled form flange 20 at one or more locations along the edge of portion 46. The peeled away portions can then be grasped manually and pulled to complete the peeling around three edges of portion 46; so that, it may be raised to the position shown in FIG. 4, but without peeling away from the top surface of lid panel 34. When the desired amount of product has been removed, portion 46 can be lowered to its closed position in which abutments 32 will keep it closed in a light tight manner. And, because membrane 54 still adheres to the portion of flange 20 surrounding portion 48 and to those portions of the upper surface of lid panel 34 to which it was heat sealed when the package was originally filled, moisture tightness is enhanced and the integrity of the package is maintained to protect the remaining product.

Those skilled in the art will appreciate that a variety of material choices are available which will provide the differential adherence of membrane 54 to lid panel 54 and flange 20 described above. Thus, we do not intend to be limited to the particular choices mentioned previously in this description.

Having described our invention in sufficient detail to enable those skilled in the art to make and use it, we claim and desire to secure Letters Patent of the United States for:

1. A packaging system, comprising:

a container body having a bottom wall and upwardly extending side walls surrounding an interior compartment of said body, said side walls having upper edges surrounding an access opening into said compartment;

a laterally and peripherally extending flange attached to said upper edges of said side walls;

a lid panel extending across said access opening and partially across said flange, whereby a peripheral portion of said flange remains exposed;

means, extending in said lid panel across said opening, for permitting a portion of said lid panel to be raised to an open position to permit access to said compartment; and seal membrane means, extended across said means for permitting and fixedly adhered at least to the upper peripheral edge of said lid panel but peelably adhered to said exposed peripheral portion of said flange, for sealing (a) said means for permitting and (b) said lid panel to said flange, whereby when said seal membrane means is grasped at said flange and pulled, said seal membrane means peels away from said exposed peripheral portion of said flange while remaining fixedly adhered to said lid panel and permitting said portion of said panel to move to said raised position.

2. A packaging system according to claim 1, wherein said flange comprises a peripherally extending, upwardly opening channel and said lid panel comprises a peripherally extending, downwardly protruding lip which fits into said channel when said lid panel is placed on said flange; and said seal membrane means extends across said channel to said exposed peripheral portion.

3. A packaging system according to claim 2, further comprising means for holding said lid panel in a closed position after said seal membrane means has been peeled from said exposed peripheral portion of said flange.

4. A packaging system according to claim 3, wherein said means for holding comprises a lateral extension of said lip and a plurality of laterally oppositely extending abutments on at least one wall of said channel, said abutments being positioned to permit said lateral extension to snap beneath them to hold said lid panel.

5. A packaging system according to claim 1, further comprising means for holding said lid panel in a closed position after said seal membrane means has been peeled from said exposed peripheral portion of said flange.

6. A packaging system according to claim 1, wherein said flange extends laterally outwardly from said access opening.

7. A packaging system according to claim 1, wherein said means for permitting is molded integrally with said lid panel.

8. A packaging system according to claim 1, wherein said flange comprises an upwardly facing surface of polypropylene, said lid panel comprises an upwardly facing surface of polyethylene and said membrane means comprises a downwardly facing surface of blackened polyethylene, which polyethylene of said membrane peelably adheres to said polypropylene of said flange but fixedly adheres to said polyethylene of said lid panel.

9. A packaging system according to claim 8, wherein said flange is made from a material comprising a lower layer of polystyrene and an upper layer of polypropylene.

10. A packaging system according to claim 1, wherein said flange comprises an upwardly facing surface of polypropylene, said lid panel comprises an upwardly facing surface of polyethylene and a downwardly facing surface of polystyrene and said seal membrane means comprises a downwardly facing surface of polyethylene, which polyethylene of said membrane peelably adheres to said polypropylene of said flange but fixedly adheres to said polyethylene of said lid panel.

11. A packaging system according to claim 10, wherein said flange is made from a material having an upper layer of polypropylene and a lower layer of polystyrene, said lid panel si made from a material having a lower layer of polystyrene and an upper layer of polyethylene and said seal membrane means is made from a material having an upper layer of metallic foil and a lower layer of polyethylene, which polyethylene of said membrane peelably adheres to said polypropylene of said flange but fixedly adheres to said polyethylene of said lid panel.

12. A packaging system, comprising:

a container body having a bottom wall and upwardly extending side walls surrounding an interior compartment of said body, said side walls having upper edges surrounding an access opening into said compartment;

a laterally and peripherally extending flange attached to said upper edges of said side walls;

a lid panel comprising two sections, said lid panel extending across said access opening and partially across said laterally and peripherally extending flange, whereby a peripheral portion of said laterally and peripherally extending flange remains exposed;

a pair of transverse, overlapping flanges, one on each of said sections, said overlapping flanges extending across said opening, for permitting one of said sections of said lid panel to be raised to an open position to permit access to said compartment; and seal membrane means, extended across said overlapping flanges and fixedly adhered at least to the upper peripheral edge of said lid panel but peelably adhered to said exposed peripheral portion of said laterally and peripherally extending flange, for (a) holding said sections together whereby said seal membrane means also functions as a hinge and enhances light tightness and (b) sealing said lid panel to said laterally and peripherally extending flange, whereby when said seal membrane means is grasped at said laterally and peripherally extending flange and pulled, said seal membrane means peels away from said exposed peripheral portion while remaining fixedly adhered to said lid panel and permitting said portion of said panel to move to said raised position.

13. A packaging system according to claim 12, wherein said laterally and peripherally extending flange comprises a peripherally extending, upwardly opening channel and said lid panel comprises a peripherally extending, downwardly protruding lip which fits into said channel when said lip panel is placed on said laterally and peripherally extending flange; and said seal membrane means extends across said channel to said exposed peripheral portion.

14. A packaging system according to claim 13, further comprising means for holding said lid panel in a closed position after said seal membrane means has been peeled from said exposed peripheral portion.

15. A packaging system according to claim 14, wherein said means for holding comprises a lateral extension of said lip and a plurality of laterally oppositely extending abutments on at least one wall of said channel, said abutments being positioned to permit said lateral extension to snap beneath them to hold said lip panel.

16. A packaging system according to claim 12, further comprising means for holding said lid panel in a closed position after said seal membrane means has been peeled from said exposed peripheral portion.

17. A packaging system according in claim 12, wherein said laterally and peripherally extending flange extends laterally outwardly from said access opening.

18. A packaging system according to claim 12, wherein said laterally and peripherally extending flange comprises an upwardly facing surface of polypropylene, said lid panel comprises an upwardly facing surface of polyethylene and said membrane means comprises a downwardly facing surface of blackened polyethylene, which polyethylene of said membrane peelably adheres to said polypropylene of said flange but fixedly adheres to said polyethylene of said lid panel.

19. A packaging system according to claim 17, wherein said laterally and peripherally extending flange is made form a material comprising a lower layer of polystyrene and an upper layer of polypropylene.

20. A packaging system according to claim 12, wherein said laterally and peripherally extending flange comprises an upwardly facing surface of polypropylene, said lid panel comprises an upwardly facing surface of polyethylene and a downwardly facing surface of polystyrene and said seal membrane means comprises a downwardly facing surface of polyethylene, which polyethylene of said membrane peelably adheres to said polypropylene of said flange but fixedly adheres to said polyethylene of said lid panel.

21. A packaging system according to claim 20, wherein said laterally and peripherally extending flange is made from a material having an upper layer of polypropylene and a lower layer of polystyrene, said lid panel is made from a material having a lower layer of polystyrene and an upper layer of polyethylene and said seal membrane means is made from a material having an upper layer of metallic foil and a lower layer of polyethylene, which polyethylene of said membrane peelably adheres to said polypropylene of said flange but fixedly adheres to said polyethylene of said lid panel.

* * * * *